United States Patent [19]

Simich

[11] 4,070,733

[45] Jan. 31, 1978

[54] PRE-NOTCHED TIEING WIRES

[75] Inventor: Emil Simich, Chicago, Ill.

[73] Assignee: A. J. Gerrard & Company, Des Plaines, Ill.

[21] Appl. No.: 708,901

[22] Filed: July 26, 1976

[51] Int. Cl.[2] ..... B65D 63/02

[52] U.S. Cl. ..... 24/27; 24/73 C

[58] Field of Search ..... 24/27–30, 24/73 C, 73 HH; 100/212, 3, 8, 34; 206/83.5; 245/1, 3, 5

[56] References Cited

U.S. PATENT DOCUMENTS

| | | | |
|---|---|---|---|
| 1,237,034 | 8/1917 | Harris | 24/27 X |
| 1,479,431 | 1/1924 | Gerrard | 24/27 |
| 2,071,089 | 2/1937 | Rowe | 24/27 |
| 3,168,912 | 2/1965 | Marica | 24/27 X |
| 3,949,450 | 4/1976 | Bailey | 24/27 |

*Primary Examiner*—Werner H. Schroeder
*Assistant Examiner*—Moshe I. Cohen
*Attorney, Agent, or Firm*—Emrich, Root, O'Keeffe & Lee

[57] ABSTRACT

A bale tie wire for use in conjunction with press platens in a baling press for baling material includes loop members formed at each end of the tie wire with a portion of each loop member bent out of the plane of each respective loop in opposite directions. Predeterminedly positioned notches are located in the bale tie wire to facilitate insertion and engagement of the bale tie wire about the corners of the baled material to provide alignment of each of the end loop members for proper engagement together.

6 Claims, 9 Drawing Figures

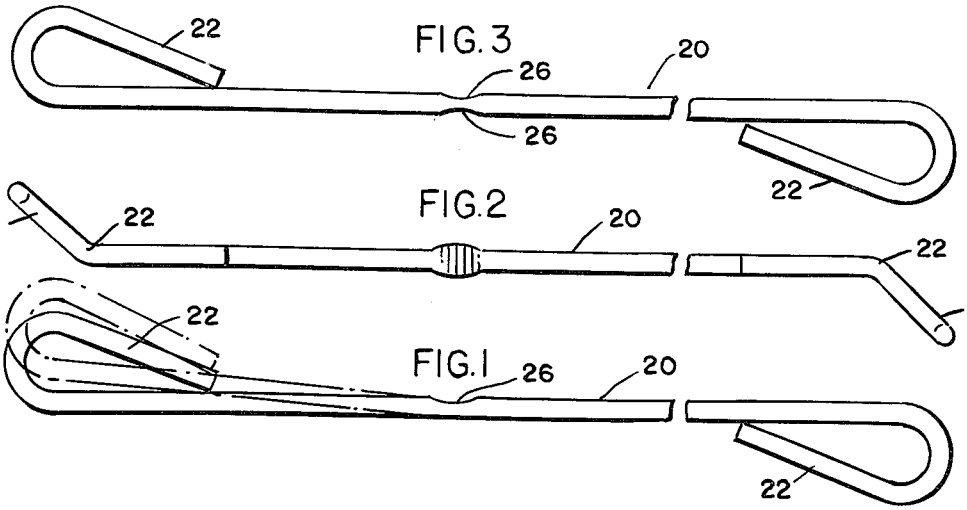
FIG. 3
FIG. 2
FIG. 1
PRIOR ART
FIG. 4
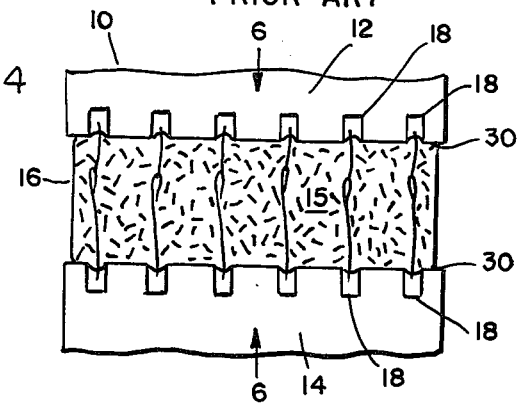
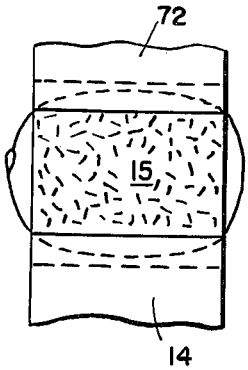
FIG. 5
PRIOR ART
FIG. 6
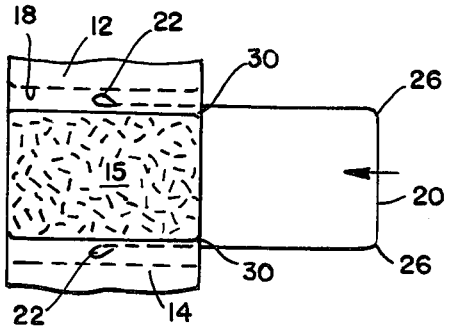
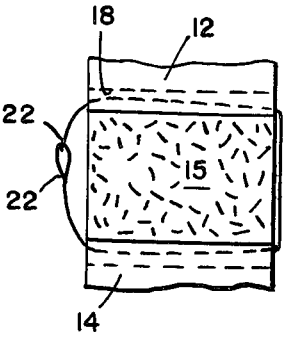
FIG. 7
FIG. 8
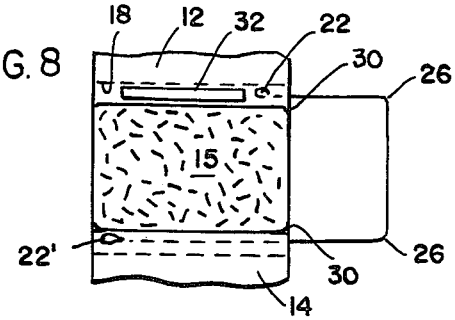
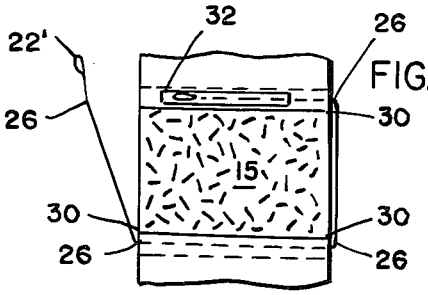
FIG. 9

PRE-NOTCHED TIEING WIRES

BACKGROUND OF THE INVENTION

This invention relates to bale tie wires and is particularly directed to improvements in the design of the bale tie wires.

In the past, bale tie wires have been generally considered to be the most economical and most desirable method of securing and holding baled material which is released from a baling press. However, because of the large stresses and high pressures involved in compressing the bale material, it has become necessary to use large diameter bale tie wire as the securing device. Unfortunately, such large diameter bale tie wire is very rigid and difficult to manually handle and manually secure the opposite looped ends of the bale tie wire together. Accordingly, the labor costs required in securing the looped ends of each of the bale tie wires together have proved a disadvantage in its application. Moreover, because of the difficulty in working with the large diameter bale tie wire, it has been found necessary to use increased lengths of the wire to provide flexible end looped portions which may be manually joined together to complete the loop around the baled material. Necessarily, such excessive lengths of tie wire have prohibited their widespread usage by the baling industry.

SUMMARY OF THE INVENTION

It is an object of the present invention to provide a bale tie wire having notches predeterminedly positioned along the length thereof to control manual bending of the wire about the corners of the baled material in a press.

It is another object of the present invention to provide a bale tie wire having notches predeterminedly positioned thereon for controlling the manual bending of the wire in a proper plane relative to the looped ends of the bale tie wire.

It is a further object of the present invention to provide an improved bale tie wire for baling materials which is inexpensive to manufacture and more efficient in operation than conventional bale tie wires.

Briefly, the bale tie wire of the present invention is useful in conjunction with a pair of press platens in a baling press for baling materials. The bale tie wire includes loops formed at each end of the wire in opposite directions, with a portion of each loop bent out of the plane of each respective loop in opposite directions thereof. At least one notch indentation is predeterminedly positioned in the bale tie wire to facilitate the ease of manually bending the bale tie wire about the corners of the baled material. The predeterminedly positioned notch provides, also, engagement of the bale tie wire about the corners of the baled material and permits alignment of each of the looped ends of the bale tie wire to facilitate manual engagement thereof. The resultant bales have increased densities because of the shorter length of tie wire used to encircle the bale.

In a further embodiment of the present invention, the bale tie wire includes loops formed at each end of the wire in opposite directions, with a portion of each loop bent out of the plane of each respective loop in opposite directions thereof. One or more notches may be predeterminedly positioned along the length of the bale tie wire and upon opposite sides of the wire in the direction of each of the looped ends. Such a notched bale tie wire may be manually bent in either direction and the symmetry of the notch or notches will maintain the straight line of the wire.

By calculating the depth of the notch or notches along the length of the bale tie wire and by positioning the tie wire about the corners of the baled material, it is possible to permit the application of a minimal length of bale tie to provide increased density on the material being packaged or baled. Additionally, it has been found that the notching should be preferably less than half of the diameter of the bale tie wire so as not to materially lessen the strength of the bale tie wire about the baled material.

DESCRIPTION OF THE DRAWINGS

FIG. 1 is a top plan view of a bale tie wire in accordance with the present invention showing a notched bale tie wire in accordance with the present invention;

FIG. 2 is a side elevation view of the bale tie wire of FIG. 1 showing the formation of the predetermined notch in accordance with the present invention;

FIG. 3 is a top plan view of a further embodiment of the present invention showing a plurality of notches on opposite sides of a bale tie wire in accordance with with the present invention;

FIG. 4 is a diagrammatic front elevation view of a conventional baling press incorporating bale tie wires in accordance with the prior art;

FIG. 5 is a diagrammatic end view of the baling press of FIG. 4;

FIG. 6 is a diagrammatic end view showing the partial insertion of a bale tie wire in accordance with the present invention into a conventional baling press;

FIG. 7 is a diagrammatic end view showing the engagement of a bale tie wire in accordance with the present invention about a bale;

FIG. 8 is a diagrammatic end view showing the partial insertion of a bale tie wire in accordance with the present invention into a conventional baling press having splicers carried by the upper platen; and FIG. 9 is a diagrammatic end view showing the full insertion of a bale tie wire in accordance with the present invention into the baling press of FIG. 8.

DETAILED DESCRIPTION OF THE DRAWINGS

Referring now to the drawings, wherein like reference numerals are used throughout the several drawings to identify the same or similar parts, in FIG. 4 there is shown a conventional baling press 10 comprising a stationary or upper base platen 12 and an lower movable platen 14 which may be actuated by a ram or other means (not shown), which is movable up and down to compress and release a bale of material 15, as is well known in the art. The upper and lower platens 12 and 14 define a press chamber 16 therebetween. The baling press 10 is useful in baling material such as cotton, stable fibers, paper and the like.

Located in each of the upper and lower platens 12 and 14 are a plurality of bale tie accommodation channels 18. As shown in FIG. 4, the bale of material 15 is compressed between the upper and lower base platens 12 and 14 and a plurality of bale tie wires are inserted about the bale and fastened together to retain and hold the bale when the upper platen is released, as is well known in the art.

As shown in FIG. 1, the bale tie wire 20 in accordance with the present invention includes a continuous wire strand having a pair of looped ends 22 formed at each end of the wire. The looped ends 22 are formed in opposite directions with respect to each other and each looped end includes an end portion 24 bent out of the plane of each respective looped end 22 in opposite directions thereof, as shown in FIG. 2.

The bale tie wire 20 includes one or more notches or recesses 26 predeterminedly positioned along the length of the bale tie wire 20 to facilitate and control the manual bending of the wire about the baled material. The notches or recesses 26 are positioned in the bale tie wire to correspond to the corners 30 of the baled material 15 thereby resulting in the use of a minimum length of tie wire 20 about the bale of material 15. By calculating the depth of the notches 26 and by positioning the depth of the notch or recesses 26 along the length of the bale tie wire, it has been found that the strength of the bale tie wire is not materially effected. Preferably, it has been found that the notching or recesses 26 predeterminedly positioned along the length of the bale tie wire 20 should be less than half of the diameter of the bale tie wire so as not to materially reduce the strength of the bale tie wire about the baled material 15. Generally, the notches 26 may be formed by dies engaging the bale tie wire 20 so that the wire may be manually bent with ease and direction at the point where the notch is positioned on the wire.

The predeterminedly positioned notches 26 along the length of the bale tie wire 20 facilitates the manual bending and insertion of the bale tie wire 20 into the accommodating channels 18 to encircle the wire about the bale of material 15. The symmetry of the notch maintains the straight line of the wire and prevents skewering of the loop ends 22 which may hinder manual fastening together of the looped ends 22.

In a further embodiment of the present invention, FIG. 3 shows a bale tie wire 20 including a continuous wire strand having a pair of looped ends 22 formed at each end of the wire. The looped ends 22 are formed in opposite directions with respect to each other and each looped end 22 includes an end portion 24 bent out of the plane of each respective looped end 22 in opposite directions thereof.

The bale tie wire 20 includes one or more notches or recesses 26 predeterminedly positioned along the length of the bale tie wire 20 and upon opposite sides of the wire in the direction of each of the looped ends 22. The notches 26 may be formed by upper and lower dies of equal radii to reduce the beam effect of the wire so that the wire may be manually bent with ease in either direction of the notch as desired. The symmetry of the notch or notches 26 maintains the straight line of the wire and prevents skewering of the looped ends 22 which may prevent manual fastening. Again, the depth of the oppositely formed notches 26 must not be such as to materially reduce the strength of the bale tie wire 20. The notches 26 are predeterminedly positioned in the wire 20 to correspond to corners 30 of the baled material 15 thereby resulting in the use of a minimum length of wire to encircle the baled material. This provides bales having increased densities over bales bound with conventional tie wires.

FIG. 6 shows the insertion of the bale wire 20, having notches 26 predeterminedly positioned along the length of the wire being inserted into the bale tie accommodating channels 18 in platens 12 and 14 to engage the corners 30 of the compressed bale 15. As shown in FIG. 7, when the looped ends 22 are manually fastened together, the tie wire 20 firmly encircles the bale 15 to provide a bale having increased density.

In FIG. 8, a bale tie wire 20 having notches 26 predeterminedly positioned along the length of the wire is inserted into the bale tie accommodating channels 18 in platens 12 and 14. The accommodating channels 18 in upper platen 12 contain interlock or splicer devices 32 therein for moving one of the loop ends 22 through the other loop end of the wire to interlock the same. Such interlock devices are described and claimed in the U.S. Pat. No. 3,863,297, assigned to the same assignor of the present invention, and, accordingly, their operation is not set forth in the present application. The splicer devices 32 anchors the threading loop end 22 with the opposite loop end 22' being inserted into the splicer device which engages and fastens the looped ends together. The wire 20 includes predeterminedly positioned notches 26 which correspond to the corners 30 of the baled material 15. The splicers release the fastened tie wire when the baled material is released from the press 10. As shown in FIG. 5, the conventional unnotched tie wires do not firmly encircle a compressed bale.

What has been described is an improved bale tie wire which provides baled materials having increased densities over conventionally wired bales with a corresponding saving in wire length and which provides bale tie wires which are easily manually engageable together with a resultant saving in labor costs.

I claim:

1. In a bale tie wire for use with press platens in a baling press for baling materials, the tie wire having a loop formed at each end of the wire in opposite directions thereof, and with a portion of each loop bent out of the plane of each respective loop in opposite directions thereof, including at least one notch predeterminedly positioned in the bale tie wire to provide engagement of the bale tie wire about the corners of the baled material and to permit alignment and engagement of each of the looped ends for fastening thereof.

2. The bale tie wire in accordance with claim 1 wherein said at least one notch is predeterminedly positioned in the bale tie wire on the surface of the wire adjacent one of the loops thereof to permit bending of the wire in one direction thereof to thereby prevent skewering of the wire during the fastening operation.

3. The bale tie wire in accordance with claim 2 wherein said at least one notch in the bale tie wire is substantially less than the radius of the wire.

4. The bale tie wire in accordance with claim 1 wherein said at least one notch is predeterminedly positioned opposite one another in the bale tie wire on the surfaces of the wire adjacent one of the loops thereof to permit bidirectional bending of the wire to provide alignment and engagement of the looped ends during the fastening thereof.

5. In a bale tie wire for use with press platens in a baling press for baling materials, the tie wire having a loop formed at each end of the wire in opposite directions thereof, and with a portion of each loop bent out of the plane of each respective loop in opposite directions thereof, including a plurality of recesses predeterminedly positioned in the bale tie wire which corresponds to the corners of the baled material which provide engagement of the bale tie wire about the corners of the baled material and which permit alignment and engagement of each of the looped ends for fastening thereof.

6. The bale tie wire in accordance with claim 5 wherein the plurality of recesses are predeterminedly positioned in the bale tie wire on the surface of the wire along the major axis thereof and perpendicular to the plane relative to the loop formed at each end of the wire to thereby permit bending of the wire about the corners of the baled material and prevent skewering of the wire during the fastening operation.

* * * * *